US006834464B2

(12) United States Patent
Shoemaker

(10) Patent No.: US 6,834,464 B2
(45) Date of Patent: Dec. 28, 2004

(54) OVERHEAD DOOR LOCK SYSTEM AND CONTROL UNIT THEREFOR

(76) Inventor: Rodney T. Shoemaker, 2490-C Saint Clair Ave., Simi Valley, CA (US) 93063

( * ) Notice: Subject to any disclaimer, the term of this patent is extended or adjusted under 35 U.S.C. 154(b) by 0 days.

(21) Appl. No.: 10/120,244

(22) Filed: Apr. 9, 2002

(65) Prior Publication Data

US 2003/0188489 A1 Oct. 9, 2003

(51) Int. Cl.[7] ..... E05B 55/00

(52) U.S. Cl. ..... 49/449; 292/DIG. 36; 70/DIG. 11; 160/201

(58) Field of Search ..... 49/197, 449; 292/DIG. 36; 70/DIG. 11, 95, 99, 100; 160/201, 290.1

(56) References Cited

U.S. PATENT DOCUMENTS

| | | | | |
|---|---|---|---|---|
| 2,926,943 | A | | 3/1960 | Leslie et al. |
| 3,664,698 | A | | 5/1972 | Stropkey |
| 4,254,582 | A | | 3/1981 | McGee |
| 4,330,958 | A | | 5/1982 | Richmond |
| 4,616,862 | A | | 10/1986 | Ward |
| 4,703,960 | A | | 11/1987 | Lense |
| 4,771,218 | A | | 9/1988 | McGee |
| 4,808,995 | A | | 2/1989 | Clark |
| 4,819,379 | A | | 4/1989 | Kenzelmann et al. |
| 4,827,667 | A | | 5/1989 | Jarvis |
| 4,884,831 | A | | 12/1989 | Emon |
| 4,978,153 | A | | 12/1990 | Hirsch |
| 4,979,384 | A | | 12/1990 | Malesko et al. |
| 4,996,795 | A | | 3/1991 | Niswonger |
| 5,001,861 | A | | 3/1991 | Hahn |
| 5,497,641 | A | | 3/1996 | Linde et al. |
| 5,533,561 | A | * | 7/1996 | Forehand, IV ..... 160/188 |
| 5,544,924 | A | | 8/1996 | Paster |
| 5,642,636 | A | | 7/1997 | Mitsui |
| 5,720,333 | A | * | 2/1998 | Turvey ..... 160/290.1 |
| 6,427,749 | B1 | * | 8/2002 | Swink et al. ..... 160/188 |
| 6,672,009 | B1 | * | 1/2004 | Wong et al. ..... 49/183 |

FOREIGN PATENT DOCUMENTS

| | | |
|---|---|---|
| CH | 205471 | 6/1939 |
| EP | 0125958 | 11/1984 |
| GB | 635939 | 4/1950 |
| GB | 2142078 | 1/1985 |

* cited by examiner

*Primary Examiner*—Jerry Redman
(74) *Attorney, Agent, or Firm*—Robert J. Schaap

(57) ABSTRACT

A locking mechanism includes a frame having a movement obstruction arm movable into a track on which rollers of an overhead door will move. When any roller on the door abuts against the arm, it will obstruct any further opening movement of the overhead door. A camming means is associated with the movement obstruction arm to automatically shift the same to a position out of the trackway when the door is moving back to the closed position. A control module is operable with the locking mechanism and receives a signal from a locking mechanism indicative of whether or not the locking mechanism is opened or closed. The control module will thereupon provide an opening signal to an opener for the overhead door.

25 Claims, 5 Drawing Sheets

OVERHEAD DOOR LOCK SYSTEM AND CONTROL UNIT THEREFOR

BACKGROUND OF THE INVENTION

1. Field of the Invention

This invention relates in general to certain new and useful improvements in overhead door locking mechanisms and, more particularly, to an overhead door locking mechanism operating in conjunction with a garage door opener control circuit for sensing the condition of the lock and controlling actuation of the garage door opener in response to whether or not the lock is in an opened or closed condition.

2. Brief Description of Related Art

Automatic overhead garage door mechanisms are well known and used in a variety of installations as, for example, residential garage doors, warehouse doors, and the like. There are also a large number of automatic door operators for opening and closing these doors. In some cases, the doors are comprised of hingedly connected individual panels which are capable of pivoting relative to other vertically arranged panels when the door is opened. Each of the panels successively shift through an arcuate path during opening movement and also in closing movement or in a reverse movement. In other cases, the door is a single panel door and capable of being moved through an arcuate path to an opened position where it may be generally disposed in a horizontal position and parallel to the floor of the installation.

In many cases, and particularly with the segmented overhead doors, such as residential garage doors, the door is movable in a fixed trackway or so-called "track". Usually, a pair of tracks are located on the opposite sides of the access opening over which the door extends and the door is movable in these tracks. Moreover, the door itself is provided with rollers mounted thereon and extending laterally from the sides of the door for rollable movement in the tracks and which thereby allows for the movement of the door relative to the tracks.

In many cases, the overhead door is operated by a door operator, as aforesaid, and only the door operator itself provides any locking activity. However, in many cases, the locking effects offered by an operator are limited. Where security is necessary for access to an installation, these operators usually do not have a sufficient locking capacity or locking capability. Consequently, it is sometimes necessary to provide an additional locking mechanism which operates in conjunction with, but which may be independent of, the door operator itself.

There have been garage door operators which provide for a locking mechanism as, for example, in the U.S. Pat. No. 6,089,626 to Shoemaker, the present applicant herein. There are also a large number of independently operated locking mechanisms such as, for example, in U.S. Pat. No. 4,771,219 to McGee. The McGee patent uses a solenoid operated locking mechanism which operates locking pins. Thus, the door lock does not operate in conjunction with the lock associated therewith. Another such locking mechanism not incorporated in a door operator is taught in U.S. Pat. No. 5,544,924 to Paster. However, it may be desirable in some cases to employ a door operator which has those desired features and to utilize a lock mechanism therefor along with a lock control circuit operative with the opener for controlling that lock mechanism.

In my U.S. Pat. No. 6,027,148 and in my aforesaid U.S. Pat. No. 6,089,626, there is provided a locking mechanism which does provide a security locking action and can be used with an overhead door, and operated with a control module therefor. The present invention, however, describes a mechanism, which is an improvement over that taught in my aforesaid U.S. patents.

OBJECTS OF THE INVENTION

It is, therefore, one of the objects of the present to provide a combination lock mechanism and control module therefor which can be used in an auxiliary capacity to a garage door opener or so-called "door operator" or which can form part of a door operator for providing a security locking condition to an overhead door.

It is another object of the present invention to provide a lock control module which is connected to a lock mechanism and provides a signal to the garage door opener depending upon whether or not the lock mechanism is in a locked condition or an unlocked condition.

It is a further object of the present invention to provide a lock mechanism which is designed with an arm capable of extending into a trackway normally designed to receive one or more rollers on an overhead sectional door. In this latter condition, the arm will block movement of the door rollers and thereby preclude movement of the door to an opened position. The lock mechanism also permits means for withdrawal of the arm from its blocking position in the track thereby allowing free movement of the door rollers and, hence, the door mounted in said trackway to the opened position.

It is an additional object of the present invention to provide a method of controlling the movement of a garage door through a control module which operates in conjunction with a lock mechanism and thereby allows operation of a door opener only if the lock is in an unlocked condition to thereby open an overhead door. In other words, the door can open or close only if the lock mechanism is unlocked.

It is another salient object of the present invention to provide a method for obtaining a security locking action for an overhead sectional door in conjunction with an opener for the door and where the condition of the lock is sensed and movement of the door is controlled in response thereto.

With the above and other objects in view, my invention resides in the novel features of form, construction, arrangement and combination of parts and components presently described and pointed out in the claims.

BRIEF SUMMARY OF THE INVENTION

The present invention provides a door lock system primarily for use with overhead doors, such as overhead sectional garage doors, in which there is provided a lock mechanism, as well as a relatively simple lock control circuit, frequently referred to as a "lock control module". This module is relatively simple and is capable of controlling the security functions of the system of the present invention.

The lock mechanism as well as the lock control circuit are used in conjunction with a conventional garage door opener and, sometimes referred to as an "operator". In this case, the garage door opener would be partially controlled through the action of the lock control module which, in turn, senses the condition of the locking mechanism, all in a manner as hereinafter described in more detail.

The locking mechanism of the invention comprises a housing which is installed independently of the garage door opener. Mounted within the housing is a shiftable arm which is adapted to extend into a track which receives rollers on the garage door. When the lock mechanism is in the locked condition it will form a barrier and thereby preclude the garage door rollers from moving. The arm is also shiftable back out of the pathway of the track in the opened condition thereby allowing movement of the rollers and hence the overhead door.

The locking mechanism of the invention further includes a solenoid which causes movement of the arm to the unlocked condition and which is also spring biased back to the locked condition. In addition, a switch is mounted on the lock mechanism and is designed to transmit a locked condition signal or an unlocked condition signal to the control module in its response to the locked or unlocked condition of the locking mechanism.

A manual override also forms part of the lock mechanism of the invention in that a user can automatically shift the arm to the locked position where it extends into the track to block the path of the rollers. The user can also manually shift the arm to the opened position to remove any obstruction in the track and thereby allow movement of the overhead door.

The locking mechanism of the invention is effective, in that it literally operates without a locking pin or lock engaging elements, such as cams, pawls, and the like. Rather, the locking mechanism causes movement of the locking bar or arm, which is shiftable into and out of the track, defining a pathway for rollers on the door itself.

The arm forming part of the locking mechanism is automatically biased to back out of the track by the action of the rollers when the overhead door is being moved from an open position to a closed position. The arm has an inclined surface which is engaged by the rollers while the door is moving to the closed position and thereby automatically biases the arm out of the pathway of the track, thereby allowing the door to move to the fully closed or lowered position.

The locking mechanism operates with the aforesaid module, in that the lock control module will provide for a ground signal to be sent to the garage door opener and which will cause the opener to open the overhead door in response to an activation signal. When the activation input signal has been received, the control module energizes an internal relay providing a 24 volt dc signal for a preset duration which energizes a solenoid in the lock to open the lock. A second and separate electrical signal is also sent from the module to the lock and back to the module to verify that the lock is opened.

After the solenoid has been energized and the lock opens, this second signal passes through the electrical switch in the lock. After passing through the closed switch the second signal returns to the control module and is used to activate the garage door opener.

Activation signals from the control module will activate the opener, when the opener connected to the door effectively receives a signal through the module that the lock mechanism is unlocked. As a simple example, when the control module is activated, the control module of the invention will enable the lock to be opened and thereby allow for movement of the overhead door to the opened position.

When there is a signal to authorizedly open the lock, the module transmits the signal to the lock mechanism, and this will cause the blocking arm to move into a position against the action of a spring, where it will not interfere with movement of the door rollers. Thus, and in this latter condition, the door will be allowed to freely move.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention. However, it is to be understood that the following detailed description and the accompanying drawings are not to be taken in a limiting sense.

BRIEF DESCRIPTION OF THE DRAWINGS

Figure 1:
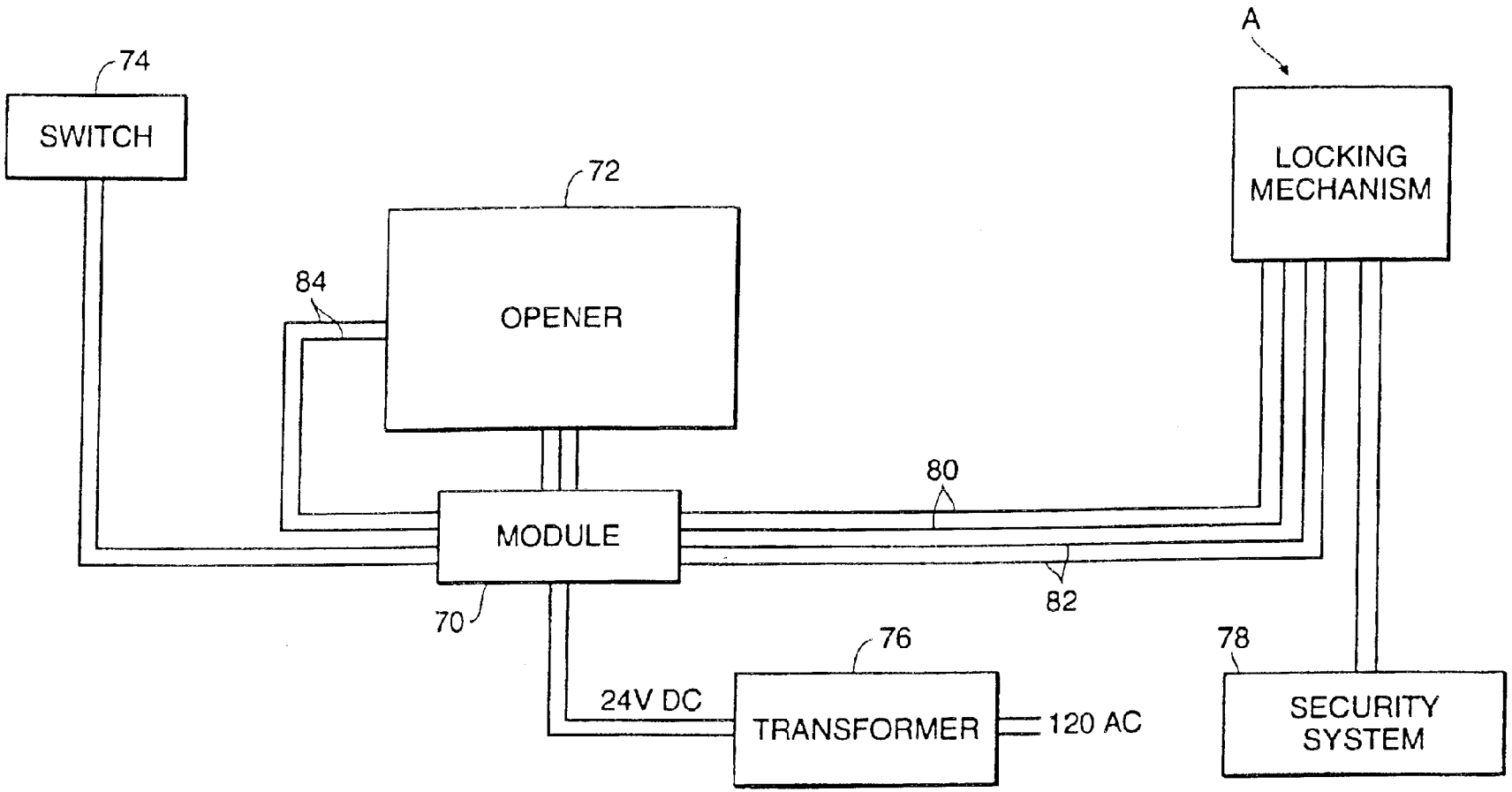
Figure 2:
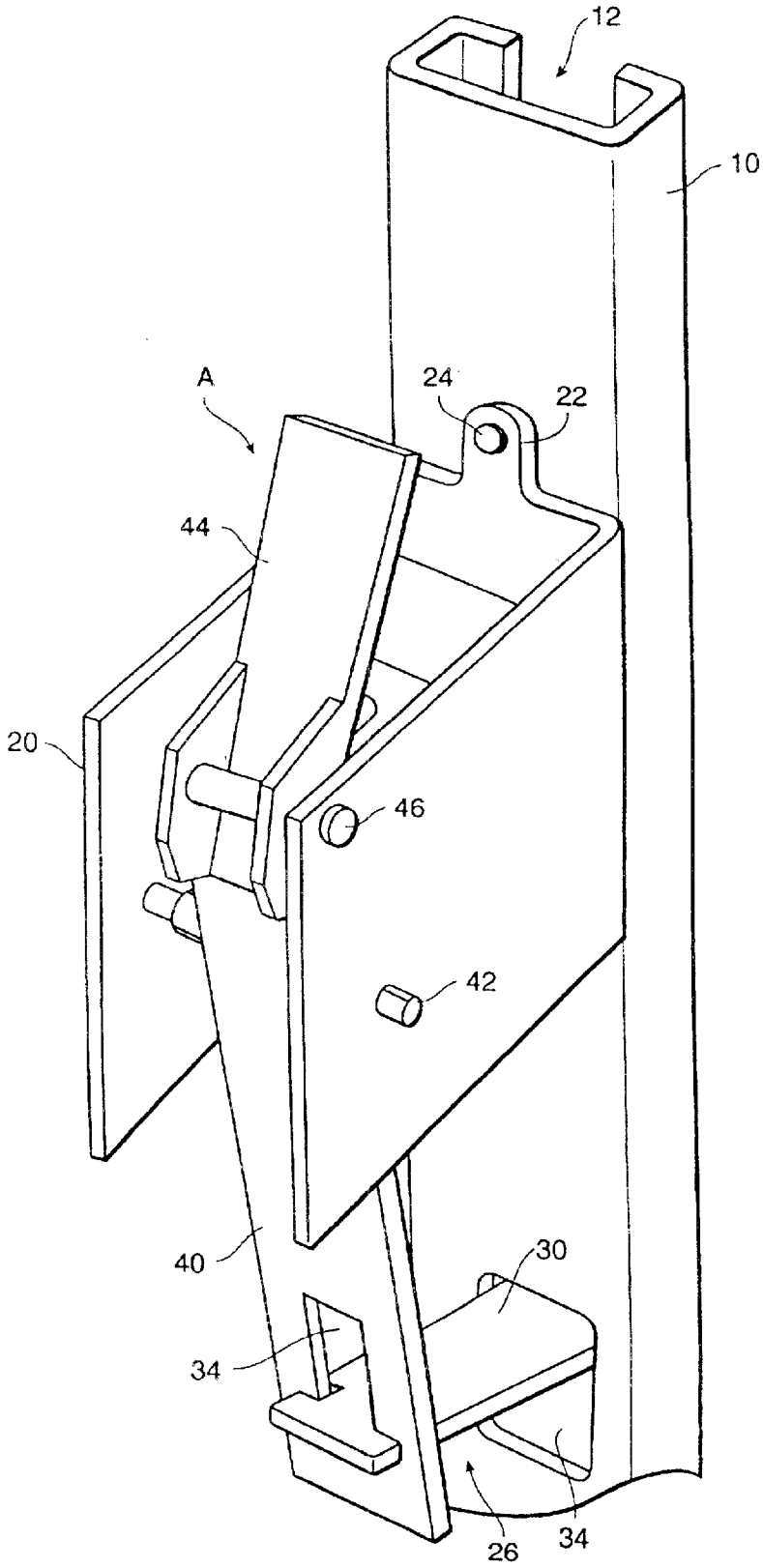
Figure 3:
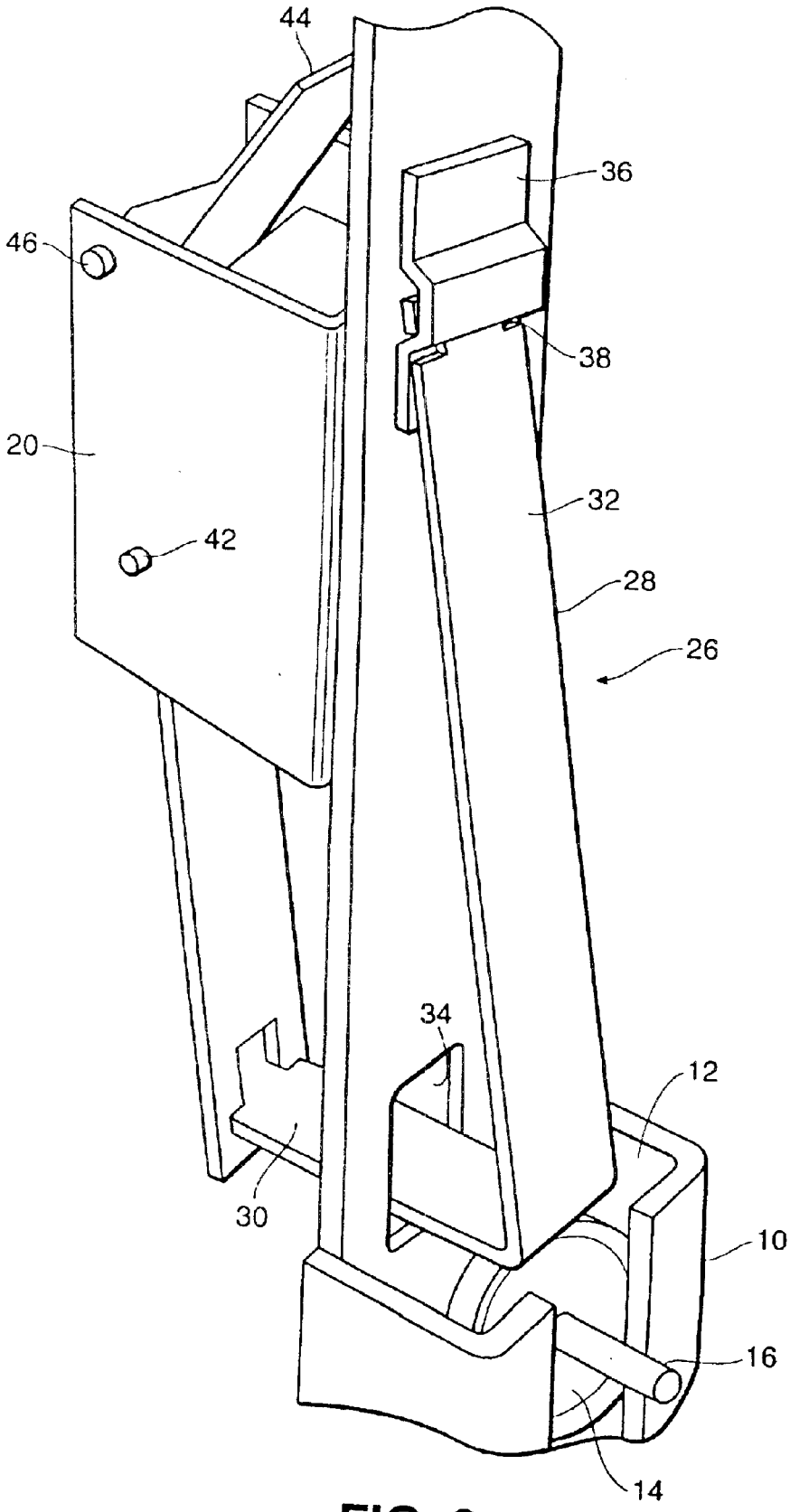
Figure 4:
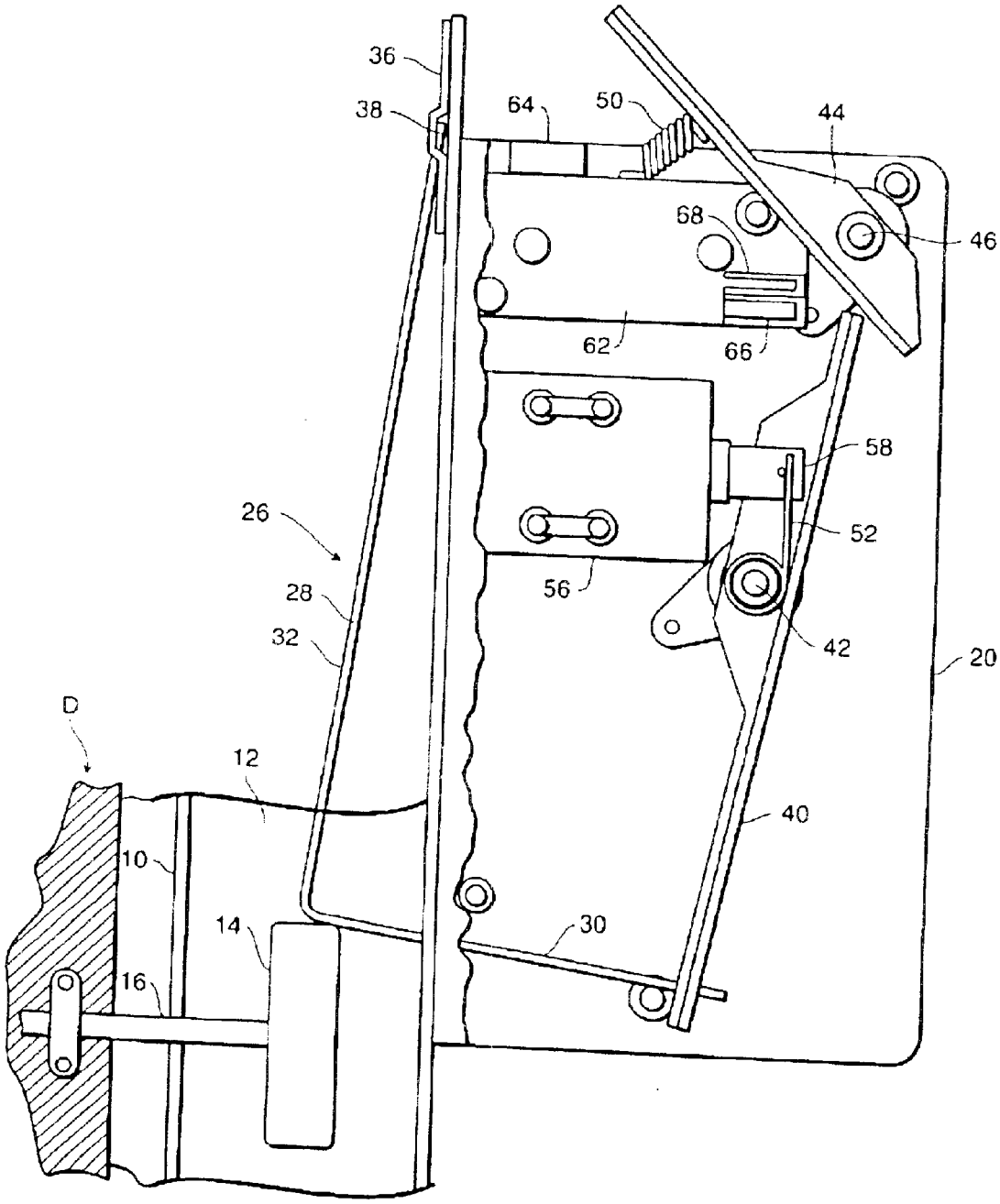
Figure 5:
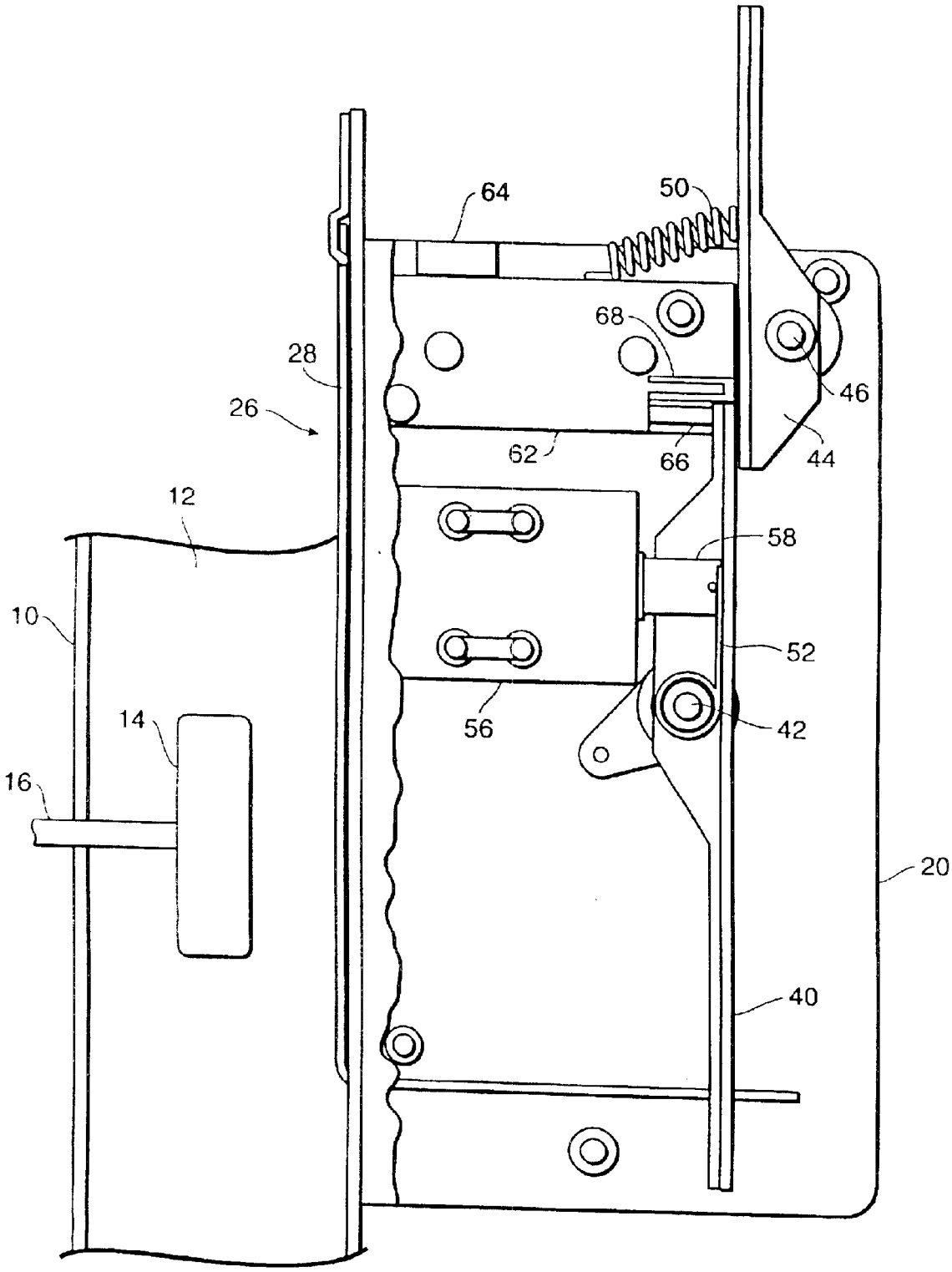

Having thus described the invention in general terms, reference will now be made to the accompanying drawings in which:

FIG. 1 is a schematic circuit diagram showing a door locking assembly of the present invention used in connection with an overhead door and an operator therefor;

FIG. 2 is a perspective view of one side of a door lock mechanism forming part of the assembly of the present invention showing the door locking mechanism in the unlocked condition;

FIG. 3 is a perspective view of the door lock mechanism of FIG. 2 in the door locking position;

FIG. 4 is a side elevational view, broken away and partially in section, and showing the overall components of the door lock mechanism of the invention and in a door locking condition; and FIG. 5 is a side elevational view, partially broken away and in section, and similar to FIG. 4, but showing the lock mechanism in an unlocked condition.

DETAILED DESCRIPTION OF A PREFERRED EMBODIMENT

Referring now in more detail and by reference characters to the drawings, FIGS. 2–5 illustrates a door locking mechanism A of the present invention used in conjunction with an overhead door D as shown in FIGS. 4 and 5. In this case, the overhead door D is schematically illustrated although it should be understood that the door D would be mounted within a suitable frame as hereinafter described.

Although the door locking mechanism of the invention is shown as being used in conjunction with a conventional door operator or opener, it should be recognized that the locking assembly, per se, including the lock mechanism and the module (both as hereinafter described), could be used independently of and not in conjunction with an opener. However, in many cases, overhead doors are frequently opened and closed through the actions of a conventional remote control operated or switch activated opener and, therefore, the lock assembly of the invention is illustrated and described in connection with an opener, shown schematically in FIG. 1.

The opener itself is of generally conventional construction and comprises a source of power, such as a conventional electric motor. This motor is used to drive some mechanism, such as a shiftable arm connected to the door, for raising and lowering the door. Otherwise, the motor could be connected to a suitable drive chain mechanism for pulling the door upwardly and allowing movement of the door downwardly to a closed position in a pair of oppositely disposed tracks forming part of the frame. Nevertheless, the details of operation of the driving member are not important to the present invention and therefore neither illustrated nor described in any further detail herein.

More specifically, the door D and one of the tracks 10 forming part of the frame is more fully illustrated in FIGS.

4 and 5 of the drawings with the track also being more fully shown in FIGS. 2 and 3. In this case, it can be observed that the track is formed by a channel defining a groove 12 for receiving rollers 14 mounted on the door D. In this respect, the rollers 14 are secured to the door D by means of roller shafts 16. As indicated above, a pair of tracks 10 are mounted with each one of the pair located on opposite sides of the door and the door is thereupon provided with rollers 14 on each of the opposite sides which roll in the tracks 10 and allow for raising and lowering movement of the door.

The door locking mechanism A is more fully illustrated in FIGS. 2–5 of the drawings and is generally mounted on an exterior surface of the track 10 in the manner as best shown in FIG. 2. For this purpose, the door locking mechanism A is comprised of a somewhat U-shaped housing or frame 20 having tabs 22 for being secured to the track 10 by any conventional fasteners such as bolts 24 or the like. Mounted on the frame 20 is a movement obstructing arm 26 which is somewhat L-shaped and has an inclined leg 28 connected to a generally horizontally located leg 30. The leg 28 has an outer ramp-like inclined surface 32 which operates as a camming surface, as hereinafter described in more detail. The movement obstructing arm 26 is secured to the inner side of a track 10 and located in the channel 12, as best shown in FIG. 3 of the drawings.

By reference to FIGS. 2 and 3, it can be observed that the generally horizontally disposed leg 30 of the movement obstructing arm 26 extends through an opening 34 located in the channel. Moreover, the generally obliquely arranged leg 28 is provided with an upper tab 36 secured to the track and is provided with a hinge portion 38 to allow the arm 26 to shift to a movement obstructing position, as shown in FIG. 3, so that the locking mechanism is in a locked condition or to an opened position, out of the trackway, as best shown in FIG. 2. FIG. 2 also shows the locking mechanism is in an opened condition.

The generally horizontally disposed leg 30 of the movement obstructing arm 26 is secured at its outer end to a locking lever 40 as shown in FIGS. 4 and 5 and which is, in turn, pivotally mounted on the U-shaped frame 20 by means of a pivot pin 42.

A manually engagable release handle 44 is shiftable into engagement with the upper end of the locking lever 40, as best shown in FIG. 4. The handle is pivotally mounted on the frame by a pivot pin 46. This manually engagable handle 44 can be grasped by the thumb and finger of a user and rotated clockwise in FIG. 4 in order to shift the movement obstructing arm to the unlocked position as shown in FIG. 5. The locking mechanism is in the locked position, as shown in FIG. 4. Moreover, the movement obstructing arm will remain in a position extending into the trackway, such that the locking mechanism is in the closed position through the action of a spring 52.

The upper end of the activating handle serves to be manually engagable by the thumb and finger of the user, in a manner to be hereinafter described in more detail. However, it can be observed that when the manually actuated handle 44 is shifted to the position as shown in FIG. 5, the movement obstructing arm 26 is moved out of the channel 12 in the track 10, and back to the retracted position as shown in FIG. 5. However, when the actuating handle 44 is shifted to an opposite position as shown in FIG. 4, the movement obstructing arm 26 is shifted to a position where it will preclude movement of the rollers 14 and hence of the door D.

Referring again to FIG. 4, it can be observed that the manually engagable actuating handle 44 is pivotally secured to the frame 20 by means of the pivot pin 46. In this way, the manually engagable actuating handle 44 can be rotated in a clockwise direction, reference being made to FIG. 4, in order to shift the movement obstructing arm 26 into the trackway in a roller blocking position, so that the locking mechanism is in the locked position, as shown in FIG. 4. The manually engagable handle 44 is also shiftable to a position where it will depress against the locking lever 40 and hence the movement obstructing arm 26 will move to a position out of the track and, that is, to an unlocked position, as shown in FIG. 5. In either case, and pursuant to action of the manual actuating handle 44, the movement obstructing arm will remain in the opened position until the manual release handle is spring biased back to the locked position, as shown in FIG. 4. At that point, the locking mechanism of the invention will operate in the normal manner as herein described.

The spring 50 is a double acting spring, which is also connected to the frame 20. In this way, and in accordance with this construction, the handle can be shifted to one position where it allows the movement obstructing arm 26 to remain in a locked position and will remain in that position. Otherwise, the handle can be shifted to an opposite position allowing the movement obstructing arm 26 to remain opened and again the arm will remain in that position. Thus, the manual release handle will remain either in the locked position or the unlocked position.

The locking lever 40 is also spring biased so that it pushes the movement obstructing arm 26 to the obstructing or locked position, by means of a spring 52 located about the pivot pin 42, as shown in FIG. 4. Thus, when the manually engagable actuating handle 44 is not used, the spring 52 will always tend to bias the locking lever 40 back to a position where it is shown in FIG. 4 and thus cause movement of the movement obstructing arm 26 to the locked position.

Referring further to FIGS. 4 and 5, it can be seen that an electrically operable solenoid 56 is mounted within the frame 20 and includes a shiftable plunger 58 capable of engaging the locking lever 40. Thus, when the plunger is retracted, pursuant to the action of the solenoid 56, the upper end of the locking lever 40 will be pulled to the left, reference being made to FIG. 4, about the pivot pin 42. In this way, the movement obstructing arm 26 is shifted back to the opened position, as shown in FIG. 5. Thus, energization of the solenoid 56 will cause an opening of the lock mechanism. In a like manner, de-energization of the solenoid 56 will enable the spring 52 to bias both the locking lever 40 and the movement obstructing arm 26 back to the closed position where it will preclude opening of the overhead door.

A simple circuit board 62 is also mounted within the frame 20 and moreover is provided with a connector pin 64 for a connection to the control module.

A switch 66 is also mounted within the frame 20 and is operable in response to the locking mechanism being in the opened position. When the locking mechanism is shifted to the opened position, as shown in FIG. 5, a signal generated from the lock control module 70 will pass through the switch 66 and return to the module, as hereinafter described. This constitutes a signal that the lock is in the opened condition. However, it can be observed that the switch 66 is actuated by the locking lever 40 in response to movement of the locking lever 40.

The locking mechanism of FIGS. 2–5 can be used independently of or in addition with a lock control module 70, as shown in FIG. 1. In this case, the module 70 that controls the locking mechanism A and the conventional door operator 72 are all connected together, as shown in FIG. 1, with the opener being physically connected to the door D. Conventionally, the opener is operated by an external manually actuable switching mechanism 74 which may adopt a form of a remote control wireless signal. In this case, however, the switching mechanism 74 is connected directly to the module which, in turn, controls the opener.

The lock control module 70 is also connected to a transformer 76 which provides a voltage source of power for operation of the module and remaining portions of the locking assembly as shown in FIG. 1.

The locking mechanism A of the invention can also be connected to a security system 78 as shown for providing a security output signal either to a remote station or to an alarm system or the like. However, the security system itself is conventional in construction and is therefore neither illustrated nor described in any further detail herein.

The lock control module 70 is activated by the external switch 74 which may be in the form of a wireless signal transmitter, such as a radio frequency signal transmitter, as aforesaid. In many cases, the opener 72 is provided with a transceiver system including a separate transmitter and a receiver operating on a radio frequency. In this case, the module itself could be so equipped with the transceiver arrangement, if desired. In any event, numerous other types of external inputs for initiating a lock mechanism opening signal can be provided.

In any event, and once an input activation signal has been detected from the switch 74, the control module 70 will energize an internal relay for a predetermined time period. This, in turn, will cause energization of the solenoid 56 within the locking mechanism. As indicated previously, energization of the solenoid 56 pulls the plunger 58 inwardly and thereby shifts the movement obstructing arm 26 to the opened position. By reference to FIG. 1, it can be observed that the opening signal to cause the locking mechanism to open is sent from the module 70 to the locking mechanism A over a pair of conductors 80.

A separate and second signal is sent from the lock control module to the locking mechanism A and back again to the control module 70 over a second set of conductors 82, as shown in FIG. 1. In effect, when the switch 66 in the locking mechanism is actuated, it allows the passage of a ground signal therethrough which effectively returns to the module and essentially informs the module that the locking mechanism is open. In this way, the module 70 will send the open signal to the opener 72 over a pair of conductors 84.

The control switch 66 effectively operates in such a manner that it does not actually generate a signal, but rather permits an electrical current to pass therethrough and back to the lock control module 70. This is, in effect, the equivalent of generating a lock open signal. Moreover, this same signal is used for transmission to the opener 72 to cause the opener to operate in a conventional manner. The locking mechanism also has normally open and normally closed outputs supplied by an internal switch 68 which can be used to control the security system 78 to thereby alert the security system when the lock is unlocked.

Thus, there has been illustrated and described a unique and novel security locking system for overhead doors which provides for a positive locking action and which can be operated with its own control system, and which thereby fulfills all of the objects and advantages which have been sought. It should be understood that many changes, modifications, variations and other uses and applications will become apparent to those skilled in the art after considering the specification and the accompanying drawings. Therefore, any and all such changes, modifications, variations and other uses and applications which do not deflect from the spirit and scope of the invention are deemed to be covered by the invention.

What is claimed is:

1. A door locking mechanism for locking an overhead door having engageable means movable in a channel of a track when in a closed position and which is releasable to allow for opening movement of the door, said locking mechanism comprising:

a) frame means capable of being mounted in proximity to said door;

b) a movement obstruction member on said frame means and being shiftable into the channel to engage a means on said door allowing for movement and thereby block movement of the member when the door is in the closed position;

c) camming means associated with said movement obstruction member to automatically force said member out of the obstructing position in the channel when the door is being moved to the closed position from the opened position; and d) means for automatically shifting the obstruction member to a position out of the channel to allow opening movement of the door.

2. The door locking mechanism of claim 1 further characterized in that said movement obstruction member is an elongate movement obstruction arm, and the camming means comprises an oblique portion of the arm which faces the movement obstruction arm and which pushes against the oblique portion forcing the arm out of an obstructing position.

3. The door looking mechanism of claim 2 further characterized in that a roller means is on the door, and means is provided for biasing said arm back to the obstructing position in the channel after the roller means has passed over and beyond said movement obstruction arm.

4. The door locking mechanism of claim 2 further characterized in that said mechanism is provided with a manually actuable activating handle and which can be shifted to cause the arm to move out of the obstructing position or back into the obstructing position.

5. The door locking mechanism of claim 4 further characterized in that said handle is spring biased so as to allow said arm to remain in an obstructing position in said track and is also spring biased to allow said arm to remain in an open position out of the channel at the selection of the user thereof.

6. The door locking mechanism of claim 1 further characterized in that the means for automatically shifting the obstruction member comprises an electrically operated component which is operable in response to an external signal.

7. The door locking mechanism of claim 6 further characterized in that the electrically operated component is a solenoid having a member operatively connected to the movement obstruction member.

8. The door locking mechanism of claim 7 further characterized in that the means for automatically shifting the movement obstruction member comprises an electrical signal to actuate the solenoid and independently thereof a manual release for manually shifting the member out of the channel.

9. The door locking mechanism of claim 1 further characterized in that a switch means is mounted on said frame and causes passage of a signal indicative of the open or closed condition of the locking mechanism.

10. A door locking mechanism for locking an overhead door having roller means movable in a channel of a track when the door is in a closed position and which is releasable to allow for opening movement of the door, said locking mechanism comprising:

a) frame means capable of being mounted in proximity to said door;

b) a movement obstruction arm on said frame means and being shiftable into the channel to engage a roller means on said door and block movement thereof when the door is in the closed position;

c) solenoid means mounted on said frame and being energized in response to an electrical signal to open said locking mechanism to allow movement of said door;

d) a plunger operable by said solenoid means and engageable with said arm to move said movement obstruction arm to a position out of the channel; and e) camming means on said movement obstruction arm to force said arm out of the obstructing position in the channel when the door is moved to the closed position.

11. The door locking mechanism of claim 10 further characterized in that said mechanism is provided with a manually actuable release handle and which can be shifted to cause the arm to move out of the obstructing position or back into the obstructing position.

12. The door locking mechanism of claim 11 further characterized in that said handle is spring biased so as to allow said arm to remain in an obstructing position in said channel and is also spring biased to allow said arm to remain in an open position out of the channel at the selection of the user thereof.

13. The door locking mechanism of claim 10 further characterized in that:

means is provided for automatically shifting the obstruction arm back to a position out of the channel in response to a signal to authorizedly open the door.

14. The door looking mechanism of claim 13 further characterized in that the means for automatically shifting the movement obstruction arm comprises means for generating an electrical signal to actuate the solenoid means and independently thereof a manual release for manually shifting the arm out of the channel.

15. The door locking mechanism of claim 14 further characterized in that a switch means is mounted on said frame and operates in conjunction with a signal indicative of the open or closed condition of the locking mechanism.

16. The door locking mechanism of claim 10 further characterized in that said solenoid means causes movement of the movement obstruction arm out of the channel in response to an open signal therefor, and timing means is associated with said solenoid means to automatically de-energize the solenoid means and permit an automatic locking of the lock after a predetermined time period.

17. The door locking mechanism of claim 10 further characterized in that:

means is provided for automatically shifting the obstruction arm back to a position out of the channel in response to a signal from a door opener allowing for opening of the door.

18. The door locking mechanism of claim 17 further characterized in that the means for automatically shifting the movement obstruction arm comprises means for sending an electrical signal from the door opener to actuate the solenoid means.

19. The door locking mechanism of claim 18 further characterized in that a switch means is mounted on said frame and operates in conjunction with a signal indicative of the open or closed condition of the locking mechanism.

20. The door locking mechanism of claim 17 further characterized in that timing means is associated with said solenoid means to automatically de-energize the solenoid means and permit an automatic locking of the lock after a predetermined time period.

21. A door locking mechanism for locking an overhead door having roller means movable in a channel of a track when the door is in a closed position and which is releasable to allow for opening movement of the door, said locking mechanism comprising:

a) frame means capable of being mounted in proximity to said door;

b) a movement obstruction arm on said frame means and being shiftable into the channel to engage a roller means on said door and block movement thereof when the door is in the closed position;

c) solenoid means mounted on said frame and being energized in response to an electrical signal to open said locking mechanism to allow movement of said door;

d) a plunger operable by said solenoid means and engageable with said arm to move said movement obstruction arm to a position out of the channel;

e) a manually actuable release handle which can be shifted to cause the movement obstruction arm to move out of or back into the obstructing position; and f) spring means biasing said handle so as to allow said arm to remain in an obstructing position in said track and also spring biasing said handle to allow said arm to remain in an open position out of the channel at the selection of the user thereof.

22. A door locking mechanism for locking an overhead door having roller means movable in a channel of a track when the door is in a closed position and which is releasable to allow for opening movement of the door, said locking mechanism comprising:

a) frame means capable of being mounted in proximity to said door;

b) a movement obstruction arm on said frame means and being shiftable into the channel to engage a roller means on said door and block movement thereof when the door is in the closed position;

c) solenoid means mounted on said frame and being energized in response to an electrical signal to open said locking mechanism to allow movement of said door;

d) a plunger operable by said solenoid means and engageable with said arm to move said movement obstruction arm to a position out of the channel;

e) camming means operatively associated with said movement obstruction arm to automatically force said arm out of the obstructing position in the channel when the door is being moved to the closed position from the opened position; and f) signal responsive means for automatically shifting the movement obstruction arm back to a position out of the channel in response to a signal to authorizedly open the door.

23. The door locking mechanism of claim 22 further characterized in that the signal responsive means for automatically shifting the movement obstruction arm comprises signal generating means for generating an electrical signal to energize the solenoid means, and independently thereof said mechanism comprises a manual release for manually shifting the arm out of the channel.

24. The door locking mechanism of claim 23 further characterized in that a switch means is mounted on said frame and operates in conjunction with a signal indicative of the open or closed condition of the locking mechanism.

25. A door locking mechanism for locking an overhead door having roller means movable in a channel of a track when the door is in a closed position and which is releasable to allow for opening movement of the door said locking mechanism comprising:

a) frame means capable of being mounted in proximity to said door;

b) a movement obstruction arm on said frame means and being shiftable into the channel to engage a roller means on said door and block movement thereof when the door is in the closed position;

c) solenoid means mounted on said frame and being energized in response to an electrical signal to open said locking mechanism to allow movement of said door;

d) a plunger operable by said solenoid means and engageable with said arm to move said movement obstruction arm to a position out of the channel;

e) said solenoid means being operable to cause movement of the movement obstruction arm out of the channel in response to an open signal therefor; and f) timing means associated with said solenoid means to automatically de-energize the solenoid means and permit an automatic locking of the lock after a predetermined time period.

* * * * *